US005704294A

United States Patent [19]

Van Winkle et al.

[11] Patent Number: 5,704,294

[45] Date of Patent: Jan. 6, 1998

[54] WATERFALL RIDE ATTRACTION

[75] Inventors: Ted W. Van Winkle; Benjamin Sheldon; Nicholas H. Drobnis; Barry Upson, all of Universal City, Calif.

[73] Assignee: Universal Studios, Inc., Universal City, Calif.

[21] Appl. No.: 719,712

[22] Filed: Sep. 27, 1996

Related U.S. Application Data

[63] Continuation of Ser. No. 614,042, Mar. 12, 1996, abandoned.

[51] Int. Cl.[6] ..... A63G 21/18

[52] U.S. Cl. ..... 104/73; 104/60; 104/70; 104/73; 472/117

[58] Field of Search ..... 104/59, 60, 70, 104/72, 73, 85; 472/13, 16, 117, 128, 129

[56] References Cited

U.S. PATENT DOCUMENTS

| | | | |
|---|---|---|---|
| 757,286 | 4/1904 | Du Clos | 104/85 |
| 838,989 | 12/1906 | Hart . | |
| 1,320,124 | 10/1919 | Churl | 104/70 |
| 1,520,217 | 12/1924 | Auperl | 104/73 |
| 3,404,635 | 10/1968 | Bacon et al. | 104/70 |
| 3,964,316 | 6/1976 | Abe . | |
| 4,142,258 | 3/1979 | Schiron . | |
| 4,149,469 | 4/1979 | Bigler | 104/70 |
| 4,337,704 | 7/1982 | Becker et al. | 104/70 |
| 4,392,434 | 7/1983 | Durwald et al. | 472/117 |
| 4,836,521 | 6/1989 | Barber | 472/117 |
| 5,183,437 | 2/1993 | Millay et al. | 472/128 |
| 5,219,315 | 6/1993 | Fuller . | |
| 5,253,864 | 10/1993 | Heege . | |
| 5,282,772 | 2/1994 | Ninomiya . | |
| 5,453,054 | 9/1995 | Langford . | |

*Primary Examiner*—S. Joseph Morano
*Attorney, Agent, or Firm*—Lyon & Lyon LLP

[57] ABSTRACT

A theme park ride attraction includes a flume path having rafts floating on flowing water. The rafts are elevated and enter into a pipe. First and second pivoting ramps are attached to the pipe and supported by an actuator. As the rafts enter onto the first pivoting ramp, the actuator quickly drops the first ramp down, simulating a waterfall event.

21 Claims, 7 Drawing Sheets

WATERFALL RIDE ATTRACTION

This application is a continuation of Ser. No. 08/614,042, filed Mar. 12, 1996, now abandoned.

BACKGROUND OF THE INVENTION

The field of the invention is amusement or theme park ride attractions.

Water based rides have been used in amusement or theme parks for many years. Typically, these conventional water based rides have a water filled channel or time. Passengers sit in a vehicle, such as a boat or raft which moves through the channel. Scenery is generally provided alongside the channel to enhance the ride experience.

Amusement ride attractions in general have become more sophisticated. At the same time, the public has come to expect increasingly exciting or more life like ride attractions. While major advances have been made in ride attractions using motion base simulators, visual, sound and other special effects, there remains a need for improved ride attractions, and especially water based ride attraction.

SUMMARY OF THE INVENTION

To these ends, it is an object of the invention to provide an improved water based amusement ride attraction. Preferably, the ride attraction includes a first flume ramp pivotally attached to a freed flume section. A second time ramp is advantageously pivotally attached to the first flume ramp. An actuator is preferably connected to the first or second flume ramps. As the actuator causes the first and second flume ramps to drop down, passengers in a raft on the ramps perceive a ride over a waterfall. In a preferred embodiment, the fixed flume section and one or both of the first and second flume ramps support a pipe enclosing the flume, water flume path or channel. A control system controls the actuator to quickly lower the flume ramps when the next raft reaches a trip point on the first flume ramp.

Other and further objects and advantages will appear hereinafter.

BRIEF DESCRIPTION OF THE DRAWINGS

In the drawings, wherein similar reference characters denote similar elements throughout the several views.

DETAILED DESCRIPTION OF THE PREFERRED EMBODIMENTS

Figure 1:
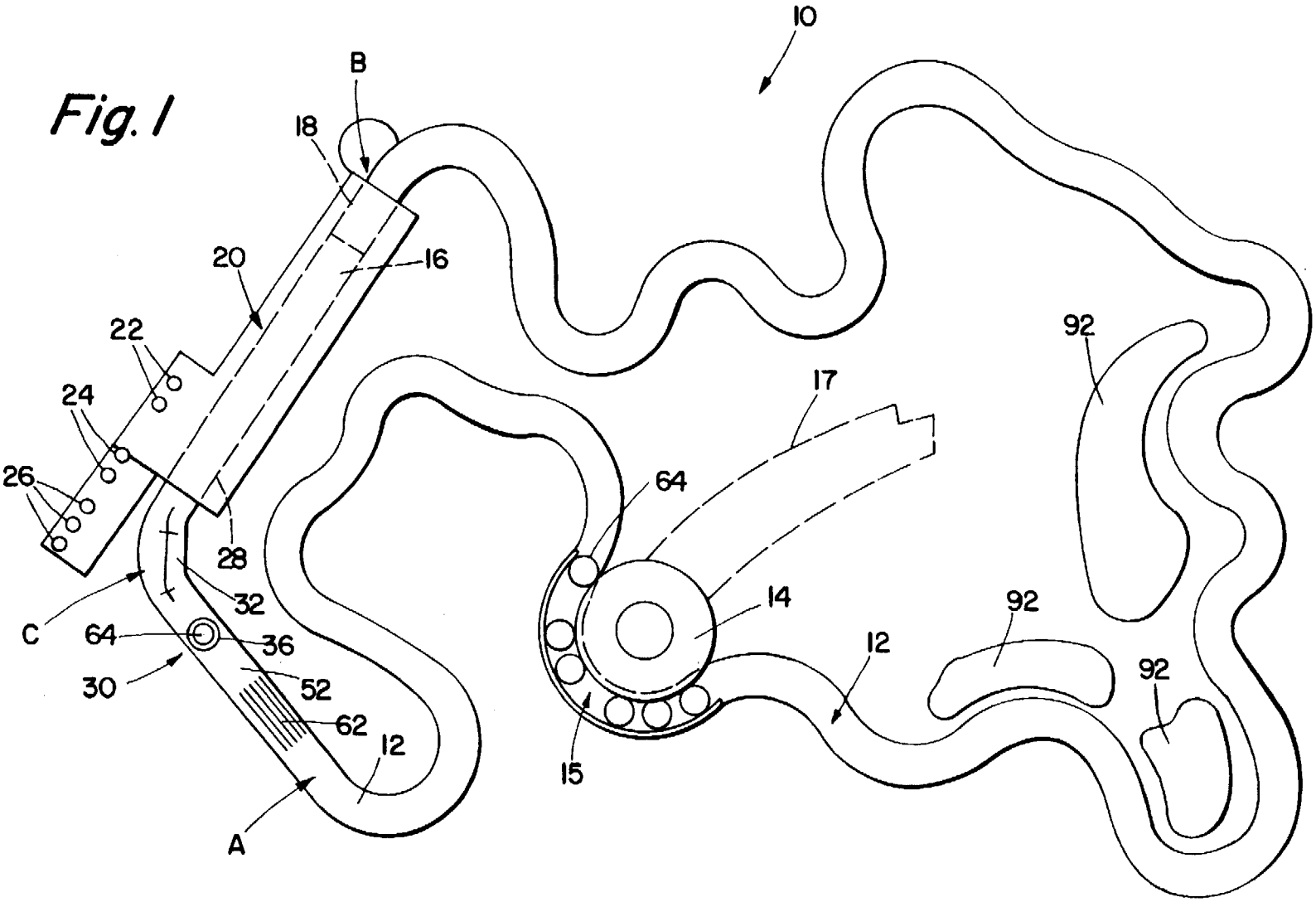
FIG. 1 is a schematic plan view of the present ride attraction.
Figure 6:
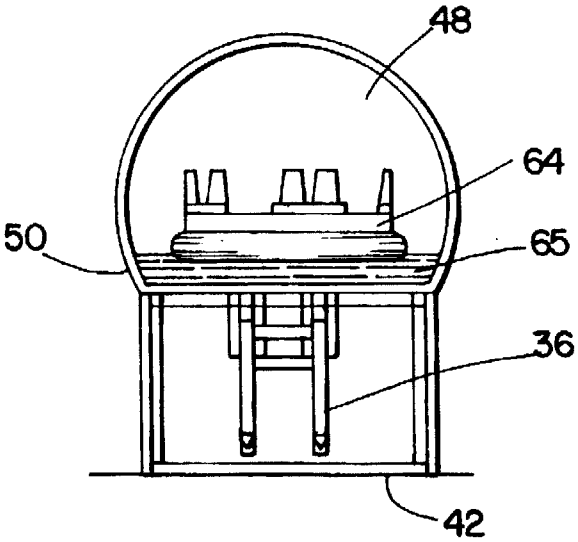
FIG. 6 is an end view of the waterfall drop shown in FIGS. 4 and 5.

Turning now in detail to the drawings, as shown in FIG. 1, the present waterfall ride attraction 10 has a channel or flume path 12. The flume path 12 is wide enough to receive and guide rafts 64. The rafts 64 are preferably round with a preferred diameter of from about 10 to 15 feet, and can carry up to 12 passengers. Referring momentarily to FIG. 6, the raft 64 includes inwardly facing seats at its perimeter.

Referring once again to FIG. 1, the flume path 12 extends approximately half way around a load/unload turntable 14. Passengers walk on to and off of the turntable via an entryway 17 which leads out of the ride attraction 10. The turntable 14 turns slowly so that its perimeter moves together with the rafts floating around the turntable in the turntable flume path section 15, to allow loading and unloading of passengers.

Figure 3:
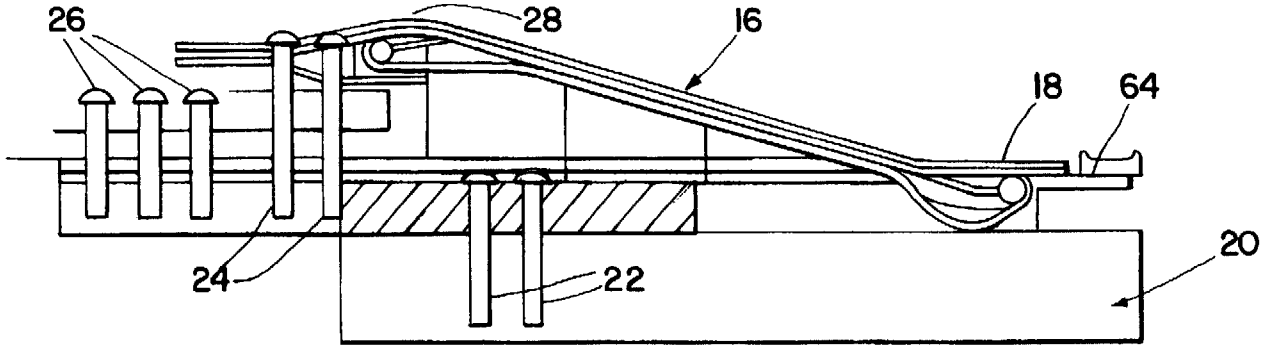
FIG. 3 is a side elevation view of the conveyor lift shown in FIG. 2.
Figure 2:
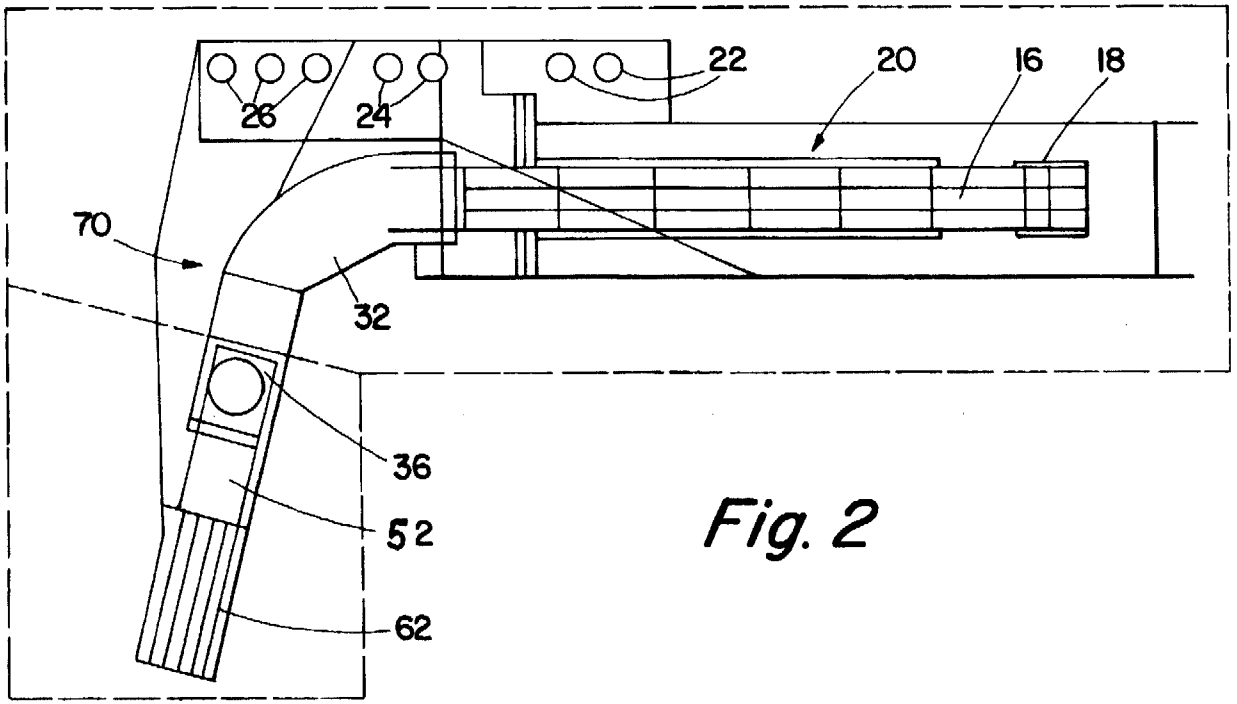
FIG. 2 is an enlarged schematic plan view of the conveyor lift and waterfall drop sections of the ride attraction shown in FIG. 1.

Turning now to FIGS. 1, 2 and 3, the flume path 12 runs slightly downhill from location A to location B. A conveyor lift 16 conveys and lifts the rafts 64 from position B to position and elevation C which is above (preferably about 10 feet) position A. As shown in FIGS. 2 and 3, the conveyor lift 16 has a spacing brake 18 to space the rafts apart. A reservoir 20 around the conveyor lift 16 holds the water used in the ride attraction 10, during shutdown when the flume path 12 is drained. Reservoir fill pumps 22 are used during start up and operation to pump water from the reservoir 20 into the flume path 12. In the preferred embodiment, an enclosed pipe 32 begins just after the crown 28 of the conveyor lift 16. As shown in FIG. 2, the enclosed pipe 32 preferably curves into a waterfall drop 30. Fog generators 34 are advantageously provided within the enclosed pipe 32, to provide a mist/fog effect. Waterfall pumps 24 pump water from the reservoir level up into the enclosed pipe 32. Ride flow pumps 26 similarly pump water from the reservoir level into a bypass channel 70 which bypasses the waterfall drop 30 before reconnecting into the flume path 12.

Figure 4:
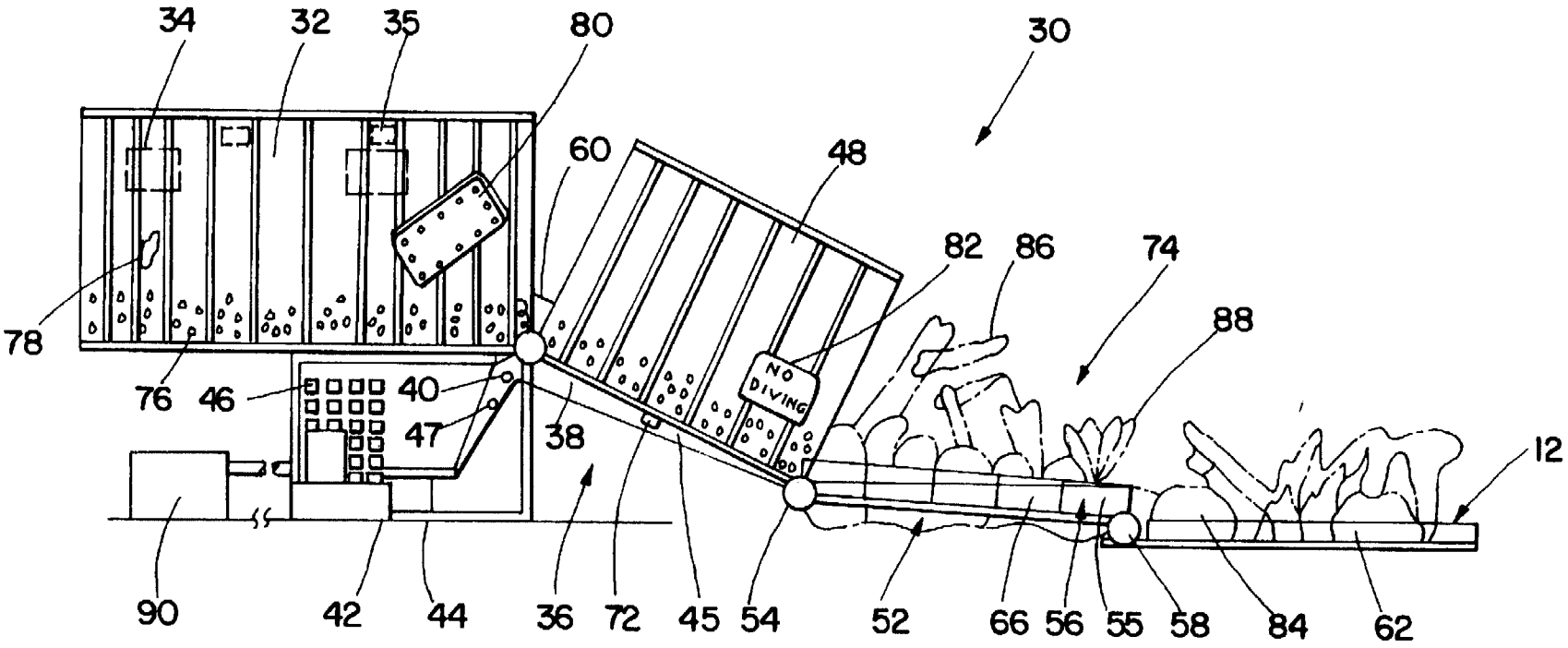
FIG. 4 is a side elevation view of the waterfall drop.
Figure 5:
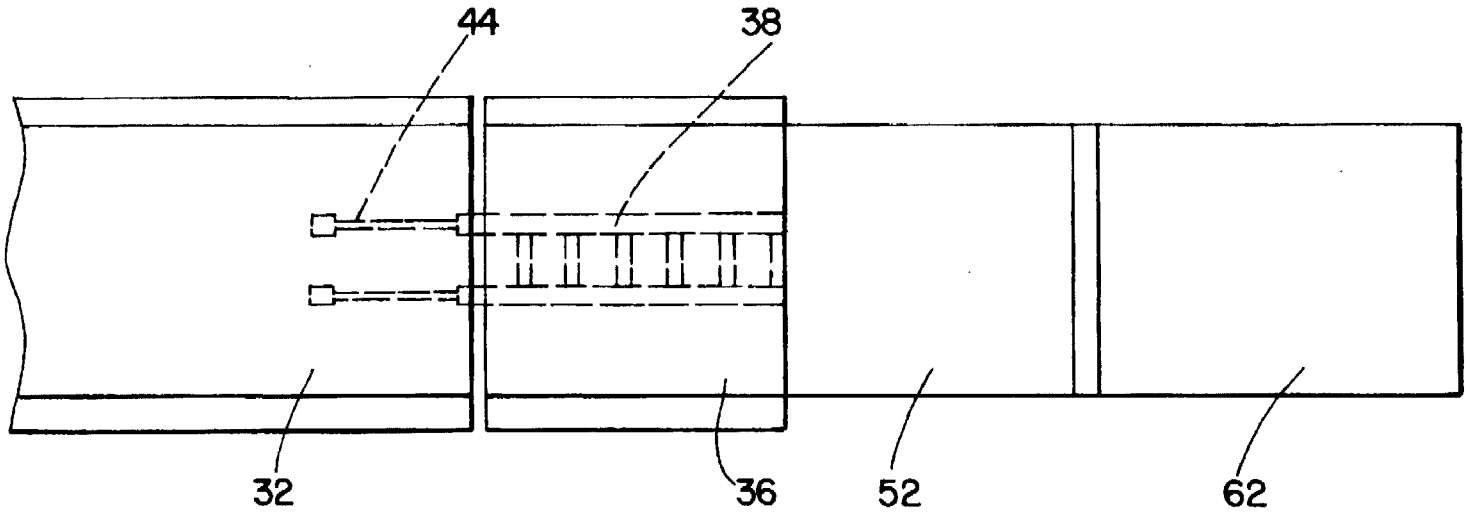
FIG. 5 is a plan view of the waterfall drop of FIG. 4.

Turning to FIG. 4, the waterfall drop 30 includes the enclosed pipe 32 which is fixed and supported on a foundation 42. The fixed, enclosed pipe 32 includes a channel or flume path to contain and direct the flow of water and rafts through it. In addition to the fog generators 34, the enclosed pipe 32 is provided with a theme, for example, by including rested areas 78, barnacles 76, patches 80, and signs 82. Sound speakers 35 are provided in the enclosed pipe 32.

Referring still to FIG. 4, a fast pivoting ramp 36 is attached to the fixed enclosed pipe 32 via a hinge joint 40. A pipe or tunnel section 48 is provided on the first pivoting ramp. An L-structure 38 is pivotally supported on the foundation 42 about the hinge joint 40. The L-structure 38 includes a first leg 45 supporting the first pivoting ramp 36, and a second leg 47 attached to an actuator 44. In the preferred embodiment, the actuator 44 is hydraulic and pumps and accumulators 46 are provided adjacent to the actuator 44.

A second pivoting ramp 52 is pivotally attached to the first ramp 36 at a pivoting ramp joint 54. The second ramp 52 is preferably open and is formed by a ramp channel section 56 having side walls 66, but no pipe or tunnel section. The downstream end 55 of the second pivoting ramp 52 has a roller 58 supported on the upstream end of a runout chute 62.

As shown in FIG. 2, the bypass channel 70 joins into the runout chute 62 after bypassing the waterfall drop 30. Advantageously, various scenery 74 is positioned around the waterfall drop area. As shown in FIG. 4, on opposite sides of the second pivoting ramp 52 scenery 74, including real or simulated rocks 84, aged wood 86 and plants 88 are provided. Animated scenes 92 are also preferably located at various positions along and either side of the flume path 12.

A trip point sensor 72 is positioned at approximately the midpoint of the first pivoting ramp 36, to detect the approach or presence of a raft 64. The trip point sensor 72 is connected to a ride controller 90.

A bellows 60 or other flexible or extending element is provided at the separation between the fast and second pivoting ramps, to guide water 65 and rafts 64.

Figure 7A:
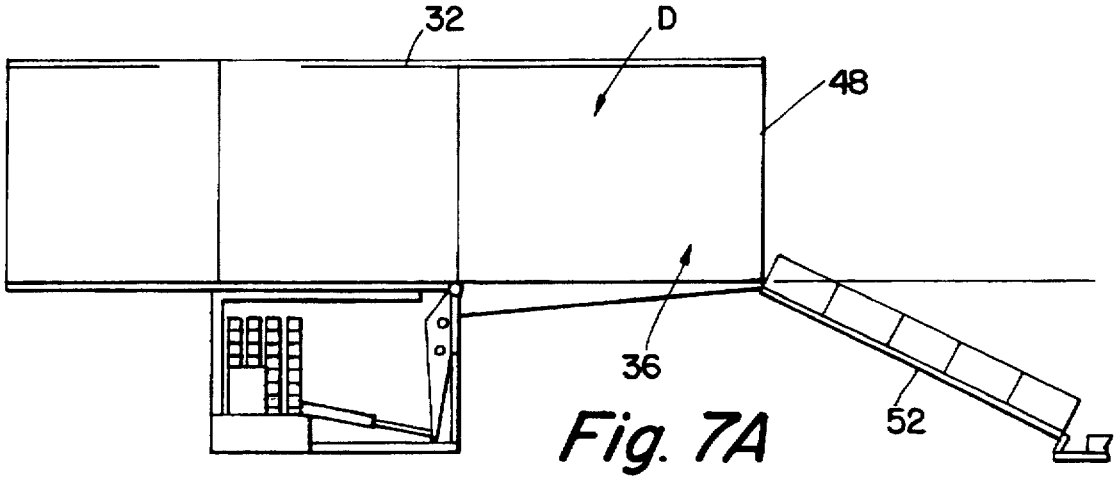
FIG. 7A is a side elevation view of the waterfall drop in the up position.
Figure 7B:
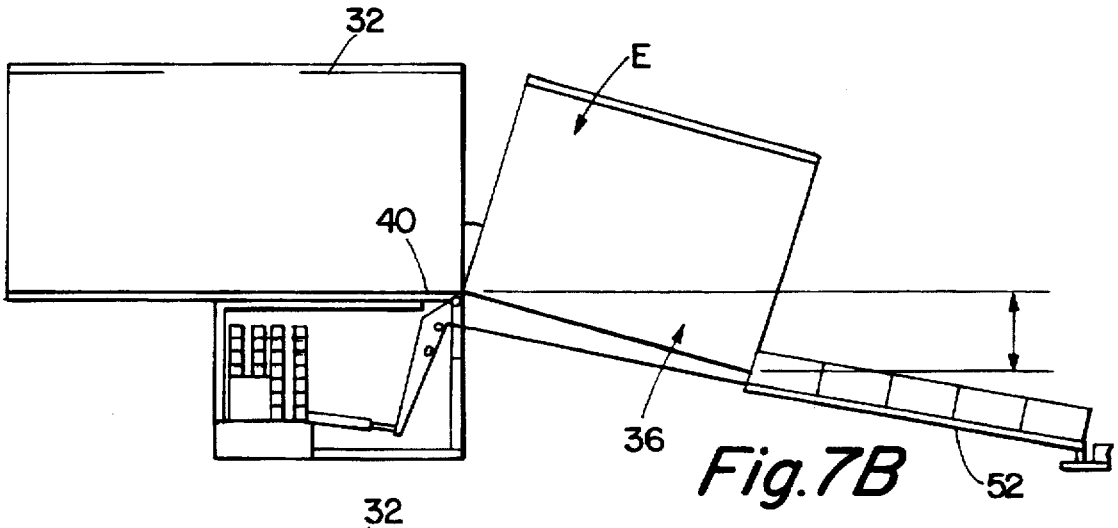
FIG. 7B is a side elevation view of the waterfall drop in an intermediate position.
Figure 7C:
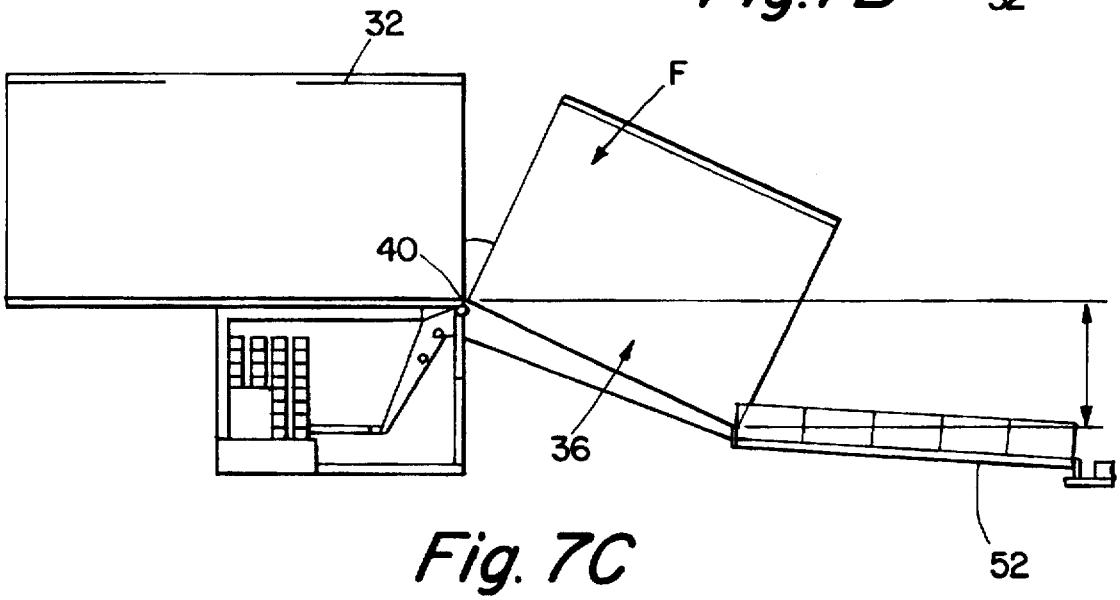
FIG. 7C is a side elevation view of the waterfall drop in the down position.

In operation, the reservoir fill pumps 22 continuously pump water from the reservoir 20 up into the enclosed pipe 32 and into the bypass channel 70. Rafts 64 are loaded and unloaded at the turntable 14, and proceed to float down through the flume path 12, via the current generated by the change in elevation from position A to position B. The lift conveyor 16 lifts the rafts 64 and passengers to position C where the rafts 64 enter into the fixed enclosed pipe 32. As a raft 64 approaches the waterfall drop 30, the first and second pivoting ramps are as shown in FIG. 7A, i.e., in the up position indicated by D. In the up position, the tunnel section 48 on the first pivoting ramp 36 is aligned and continuous with the enclosed pipe 32. When the raft 64 reaches the trip point sensor 72, the presence of the raft 64 is detected by the controller 90, which drives the actuator 44, causing the first pivoting ramp 36 to pivot quickly downwardly, as shown in FIGS. 7B and 7C. As the first pivoting ramp 36 pivots about the hinge joint 40, the second pivoting ramp 52 pivots with respect to the first pivoting ramp 36 about the ramp joint 54. The roller 58 shifts slightly back and forth on the base of the runout chute 62. In the down position F, as shown in FIG. 7C, and in FIG. 4, the bellows 60 maintains a continuous flume path through the pipe 32 and tunnel section 48, to prevent water from flowing out of the flume path 12 with the waterfall drop 30 in the down position.

In operation, the passengers experience the sensation of traveling through a pipe, partially filled with water and fog, and feel and hear an audio enhanced impending waterfall.

As a raft passes out of the end of the pipe 32, the fog clears and the pipe appears to suddenly break off and drop out from underneath the raft. The riders experience a quick vertical drop, and then slide into the runout chute 62 and the flume path 12. As water flows over the pivoting ramps and runout chute, the passengers perceive a continuous water route. The raft floats freely through the flume path 12 and waterfall drop 30, without mechanical interconnection to the flume path or other supporting structure. The passengers do not perceive movement until the raft reaches the midpoint of the first pivoting ramp, when the quick vertical drop occurs. Because the passengers are within the tunnel section 48 when the dropping movement begins, they perceive that the enclosed pipe 32 is breaking off and falling downwardly. After the raft 64 has moved away from the waterfall drop 30, the controller 90 causes the actuator 44 to lift the first and second pivoting ramps, to reset the waterfall drop back to the position shown in FIG. 7A. A typical dispatch interval is preferably about 15 seconds (maintained by the spacing brake 18), with the rafts floating through the waterfall drop at a forward speed of about 5 feet per second. To prevent approaching passengers, and passengers moving downstream in the runout chute from seeing operation of the waterfall drop, the waterfall drop should preferably be able to cycle from full up to full down and back to full up positions in under 4 seconds. Preferably, the waterfall drop 30, via the first and second pivoting ramps, can be used with the ramps fixed in any one of the positions shown in FIGS. 7A, 7B and 7C (i.e., with the actuator disabled).

The flume path 12 is preferably from about 12–20 feet wide, and with the enclosed pipe 32 and tunnel section 48 being from 1–2 feet wider. For an embodiment having a 16 foot wide flume path 12, the first pivoting ramp is preferably about 18 feet and the second pivoting ramp approximately 20 feet. The duration of the pivoting movement from the up position D to the down position F, as shown in FIGS. 7A and 7C is preferably about 0.3 seconds. This movement simulates the sensation of failing over a waterfall. The controller 90 is linked to a ride show supervisor controller, for controlling overall operation of the ride attraction 10, including the fog generators, sound speakers, and lighting.

Figure 8:
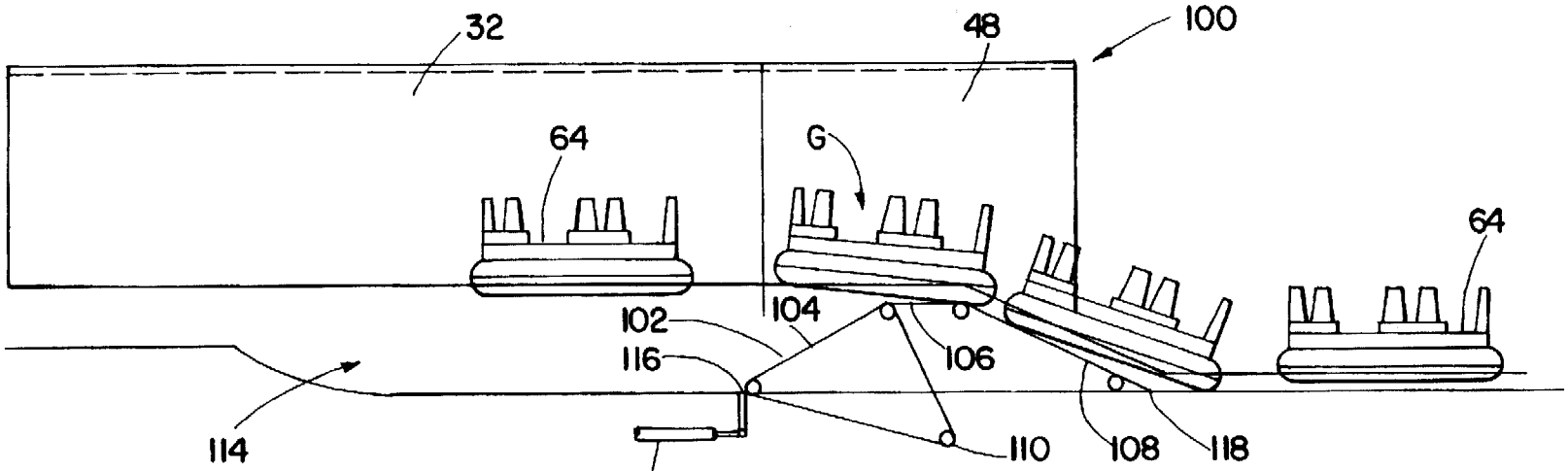
FIG. 8 is a side elevation view of an alternative waterfall drop embodiment, in the up position.
Figure 9:
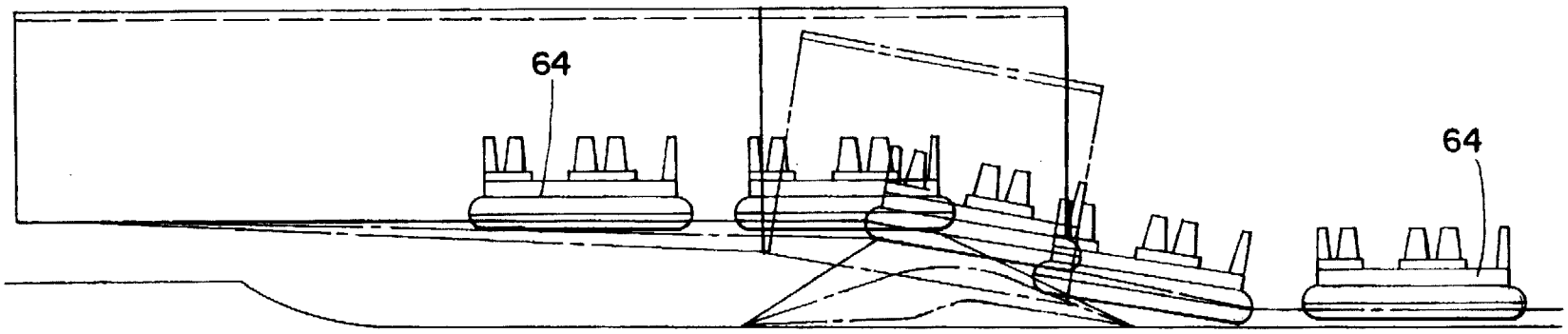
FIG. 9 is a side elevation view thereof, in the down position.
Figure 10:
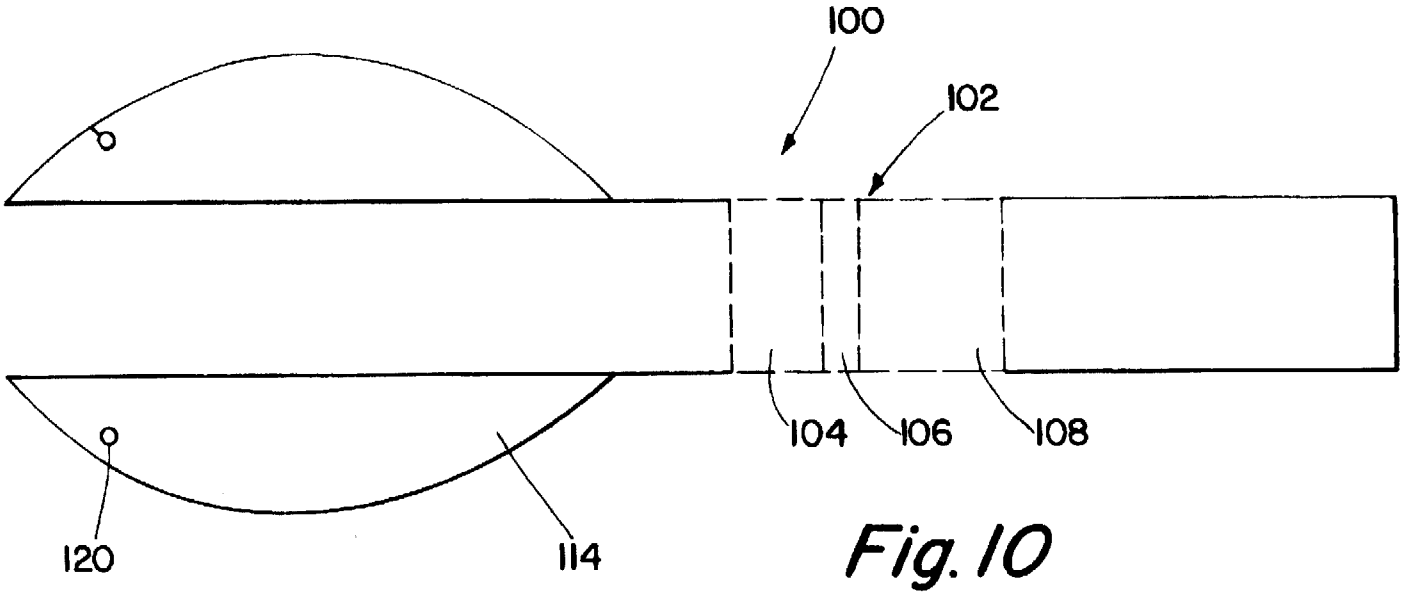
FIG. 10 is a top plan view of the embodiment of FIG. 8.

As shown in FIGS. 8–10, in an alternative embodiment 100 a collapsible or movable dam 102 is used to provide a simulated waterfall effect. The dam 102 is located at the downstream end of a waterfall reservoir 114. The dam 102 has an upstream wall or surface 104, a generally flat top 106, and a downstream wall 108, as shown in FIG. 8. The upstream and downstream walls are pivotally connected to the top. An actuator 112 is positioned between a foundation and the upstream wall 104. A strut extends from a fixed pivot point 110 to the pivot joint connecting the upstream wall 104 and the top 106. The leading edge 116 of the upstream wall 104 is vertically supported on the floor of the waterfall reservoir 114 via rollers, or equivalents, to allow horizontal, but not vertical, movement. The trailing edge 118 of the downstream wall 108 is similarly supported. Referring to FIG. 10, waterfall pumps 120 are arranged to pump water into the reservoir 114.

Figure 11:
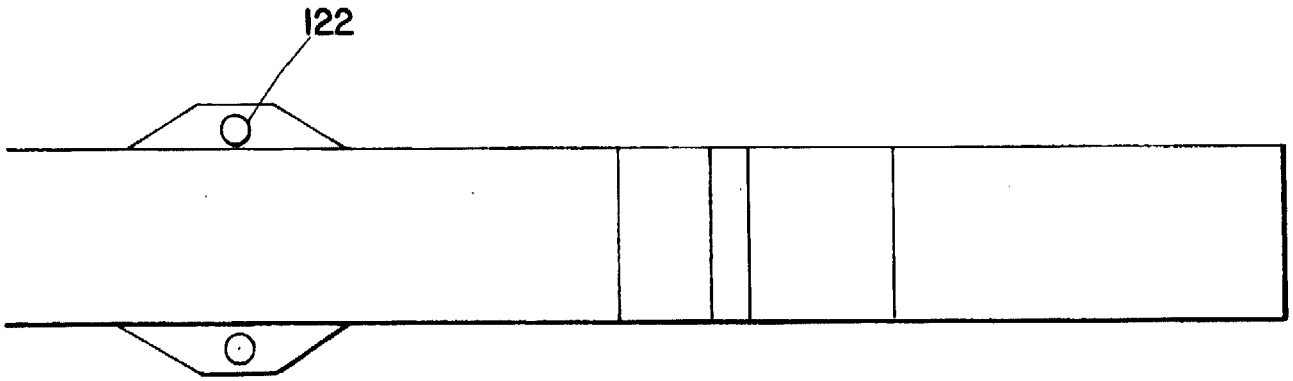
FIG. 11 is a top plan view of a modified alternative embodiment.

In use, the dam 102 is initially in the up position, as shown in FIG. 8. In this position, the dam 102 backs up a significant head of water, preferably about 2–5 feet. When a raft 64 reaches a trip point (position G in FIG. 8), the actuator 112 quickly retracts, causing the dam to flatten out or collapse, as shown in FIG. 9. The rapid drop of the dam 102 causes the raft 64 to drop suddenly and move forward on the surge of water released from the waterfall reservoir 114. After the raft 64 moves away from the waterfall area, the actuator reverses to re-erect the dam. Pumps 120 replenish the water level of the reservoir. The waterfall 100 is then ready for the next raft. If the reservoir is large, as in FIG. 10, slower pumps 120 may be used, as the water escaping over the dam with each raft is small in relation to the volume of the reservoir, resulting in a minimal reservoir water level drop. If a smaller reservoir, or no reservoir, is used, then faster pumps 122, as shown in FIG. 11, may be required. Preferably, rafts 64 can readily pass over the dam, whether the dam is in the up or down position, or in any intermediate position, so that the ride attraction may be operated without using the waterfall. The flat top 106 on the dam 102 prevents the rafts 64 from rocking or tilting while passing over the dam.

Thus, while various features have been shown and described, many changes can be made without departing from the spirit and scope of the present invention. The invention, therefore, should not be restricted, except by the following claims.

What is claimed is:

1. An amusement ride attraction for carrying passengers in a raft comprising:

a fixed flume section;

a first flume ramp pivotably attached to the fixed flume section;

a second flume ramp pivotably attached to the first flume ramp; and an actuator connected to one of the first and second flume ramps for quickly lowering the ramps as the raft moves over them.

2. The amusement ride attraction of claim 1 further comprising a pipe on at least one of the fixed flume sections and first flume ramp, with the pipe forming a tunnel.

3. The amusement ride attraction of claim 2 further comprising a fog generator in the pipe.

4. The amusement ride attraction of claim 1 further comprising a runout chute adjacent to the second flume ramp.

5. The amusement ride attraction of claim 4 further comprising scenery adjacent to the second flume ramp and runout chute.

6. The amusement ride attraction of claim 4 further comprising a water flume path connecting to the fixed flume section and runout chute, and forming a substantially closed loop.

7. The amusement ride attraction of claim 1 further comprising an L-structure supporting the second flume ramp and connected to the actuator.

8. The amusement ride attraction of claim 1 further comprising a trip point sensor on the first flume ramp, and a controller linked to the trip point sensor and the actuator.

9. The amusement ride attraction of claim 1 further comprising a water flume path connecting to the fixed flume section and second flume ramp.

10. The amusement ride attraction of claim 9 further comprising water in the flume path and pumps for pumping the water.

11. The amusement ride attraction of claim 10 further comprising a plurality of rafts adapted to float in the flume path.

12. The amusement ride attraction of claim 10 further comprising guide walls on at least one of the first and second flume ramps for guiding rafts and water over the flume ramps.

13. The amusement ride attraction of claim 9 further comprising a conveyor lift in the flume path.

14. The ride attraction of claim 1 wherein the first flume ramp and second flume ramp are longer than the raft.

15. An amusement ride attraction comprising:

a fixed flume section;

a first flume ramp pivotably attached to the fixed flume section;

a second flume ramp pivotably attached to the first flume ramp;

an actuator connected to one of the first and second ramps;

a runout chute adjacent to the second flume ramp; and a roller on the second flume ramp supported on the runout chute.

16. An amusement ride attraction comprising:

a fixed flume section;

a first flume ramp pivotably attached to the fixed flume section;

a second flume ramp pivotably attached to the first flume ramp;

an actuator connected to one of the first and second ramps;

a water flume path connecting to the fixed flume section and second flume ramp;

water in the flume path and pumps for pumping the water; and a bypass channel in parallel with the water flume path and bypassing the first fixed flume section, and the first and second flume ramps.

17. An amusement ride attraction having a raft floating on water comprising:

a flume section;

a first flume ramp pivotably attached to the flume section;

a second flume ramp pivotably attached to the first flume ramp;

the flume section, first flume ramp and second flume ramp forming a contiguous flume path carrying the water;

an actuator connected to one of the first and second flume ramps; and the first flume ramp and second flume ramp rapidly movable via the actuator from a first position under the raft, upon a sensed presence of the raft on the first flume ramp, to a second position below the first position, thereby providing a simulated waterfall effect.

18. An amusement ride attraction comprising:

a flume path extending into a waterfall reservoir;

a collapsible dam at a downstream end of the waterfall reservoir, the collapsible dam including:

an upstream wall, a top, and a downstream wall;

the upstream wall having a first end vertically supported on a floor and a second end pivotably attached to the top;

the downstream end having a first end vertically supported on a floor and a second end pivotably attached to the top; and an actuator linked to the dam.

19. An amusement ride attraction comprising:

a flume path extending into a waterfall reservoir;

a collapsible dam at a downstream end of the waterfall reservoir comprising:

an upstream wall including a trailing edge, and a leading edge horizontally slidable on an upstream vertical support;

a top pivotably attached to the trailing edge of the upstream wall;

a downstream wall with a leading edge pivotably attached to the top and a trailing edge of the downstream wall horizontally slidable on a downstream vertical support; and means for erecting and collapsing the dam.

20. The ride attraction of claim 19 wherein the means for erecting and collapsing comprises an actuator which moves the dam from an erected position under a raft traversing the dam, to a collapsed position, in response to a sensed presence of the raft at the dam, so as to simulate a waterfall effect.

21. A method of simulating the sensation of falling over a waterfall in a raft, comprising the steps of:

(a) floating a raft on water from a flume section onto a first flume ramp which is pivotably connected to a second flume ramp, the first flume ramp pivotably attached to the flume section, and extending therefrom in a first position level to the fixed flume section;

(b) sensing the presence of the raft on the first flume ramp;

(c) rapidly pivoting the first and second ramps downwardly to a second position below the first position; and (d) allowing the raft to rapidly drop down the first flume ramp onto the second flume ramp to simulate a waterfall effect.

* * * * *